US005107940A

United States Patent [19]

Berry

[11] Patent Number: 5,107,940

[45] Date of Patent: Apr. 28, 1992

[54] TOP DRIVE TORQUE RESTRAINT SYSTEM

[75] Inventor: Joe R. Berry, The Woodlands, Tex.

[73] Assignee: Hydratech, Houston, Tex.

[21] Appl. No.: 627,711

[22] Filed: Dec. 14, 1990

[51] Int. Cl.[5] ..... E21B 3/02; E21B 15/00

[52] U.S. Cl. ..... 175/85; 175/122; 175/162; 175/220

[58] Field of Search ..... 175/85, 113, 122, 162, 175/203, 220, 52; 173/38, 39, 45, 163

[56] References Cited

U.S. PATENT DOCUMENTS

| | | | |
|---|---|---|---|
| 2,803,434 | 8/1957 | Heinish | 175/85 X |
| 4,371,041 | 2/1983 | Becker et al. | 175/85 X |
| 4,421,179 | 12/1983 | Boyadjieff | 173/44 |
| 4,449,596 | 5/1984 | Boyadjieff | 175/85 |
| 4,570,706 | 2/1986 | Pugner | 175/162 X |
| 4,589,503 | 5/1986 | Johnson et al. | 175/113 |
| 4,593,773 | 6/1986 | Skeie | 175/85 |
| 4,610,315 | 9/1986 | Koga et al. | 175/85 |
| 4,667,752 | 5/1987 | Berry et al. | 175/85 |
| 4,850,439 | 7/1989 | Lund | 175/85 X |

FOREIGN PATENT DOCUMENTS

| | | | |
|---|---|---|---|
| 2225521 | 12/1972 | Fed. Rep. of Germany | 175/85 |
| 8907188 | 8/1989 | PCT Int'l Appl. | 175/85 |

*Primary Examiner*—Hoang C. Dang
*Attorney, Agent, or Firm*—Mary J. Gaskin

[57] ABSTRACT

A torque restraint system for a top drive unit in a drilling rig, in which rigid torque arms rotate about a horizontal axis to transmit reactive force from the power swivel to the mast to prevent rotation of the power swivel about a vertical axis. The rotatability of the torque arms also allows lateral displacement of the motor from an operating position to a parked position behind the vertical axis of the well bore. The torque restraint system can be utilized in conjunction with an inclined mast.

5 Claims, 13 Drawing Sheets

TOP DRIVE TORQUE RESTRAINT SYSTEM

TECHNICAL FIELD

The invention relates to a portable, telescoping-mast, earth drilling rig having a top power swivel wherein rigid torque arms are pivotally connected between the power swivel and guide track mounted on the vertical or inclined mast to prevent rotation of the power swivel about a vertical axis as the power swivel moves vertically and transmits torque to the drill string.

BACKGROUND OF THE INVENTION

Top drive drilling systems have proven to be very reliable and are used extensively in offshore drilling applications.

Use of an overhead top drive eliminates the need for the conventional rotary table and increases drilling efficiencies from 15 to 25 percent over kelly drilling.

Although top drive drilling systems have proven to be very effective, efficient, and safe tools, few are used onshore. Top drive units developed for offshore drilling applications are not readily adaptable for use in onshore applications. The systems require the use of a guide track attached to a mast, which acts as a torque-restraining structure, extending parallel to the direction of the movement of the traveling block for the purpose of preventing rotation of the traveling block and top drive relative to the mast of the drilling rig.

Top drive drilling systems for onshore portable drilling rigs have not enjoyed commercial success in heavy drilling operations for drilling deep wells. Instead, portable power swivel units have been used primarily for drilling wells deeper, working over a well, and for well servicing. These units require a vertically-tensioned cable extending from the drill floor to a suitable point on the mast structure to react the drilling torque from the power swivel. The application of the lateral torque reaction to the vertically-tensioned cable results in significantly increased cable tension, thereby reducing the mast's hoisting capacity. For the most part, portable drilling rigs have been designed to minimize the weight of the mast and associated equipment. Since the guide tracks and torque lines for top drive drilling systems have had to be vertical, the primary advantages of top drive systems have not been heretofore adapted to a mast of a portable land rig whose longitudinal axis is not necessarily parallel to the vertical axis of the well bore.

The invention described herein discloses an improved structure for guiding power swivels used on vertical or inclined, leaning masts which are generally required for heavier drilling operations. The top drive drilling system described is completely portable and usable for onshore applications.

Prior art has heretofore failed to solve the problems in onshore use of top drive drilling systems.

For instance, U.S. Pat. No. 4,667,752 discloses a carriage and vertical guide tracks for preventing rotation of the drive unit about a vertical axis. However, it and other such systems in the prior art require that the guide tracks always be vertical and parallel to the vertical axis to maintain the drive unit above the well opening.

SUMMARY OF THE INVENTION

The top drive drilling system described herein utilizes existing technology to adapt the proven advantages of the large offshore top drive drilling system to a system for use on portable land rigs at a fraction of the cost.

The drilling system disclosed is lightweight, compact, and easy to transport and install It combines the functions of providing drilling torque and pipe handling into a unit which remains in the traveling assembly for all operations. However, because of its light weight and small size, the unit may be removed from the string in a matter of minutes. Total drilling time is reduced due to several features:

(1) the system's ability to add stands of drill pipe instead of individual joints of pipe when making a connection;

(2) the system's ability to "back-ream", or rotate and circulate, while pulling out of a hole, even in and out of highly-deviated or horizontal wells;

(3) the reduced orientation time for directional control.

The top drive drilling system disclosed herein is adapted to travel on guide tracks which are not necessarily parallel to the direction of movement of the traveling block. Torque arms pivot to transmit the reactive torque from the power swivel to the guide tracks and mast while allowing vertical travel of the traveling block and power swivel. The drive and guide mechanism is fully compatible with existing conventional masts and can be installed to convert existing land rigs to top drive units without extensive modification of the mast. Unlike conventional power swivels on land rigs, no torque cables are required through the drill floor. The torque reactions are taken by the mast and do not compromise the integrity of the structure. The guide rails in the mast top section may be permanently attached and those in the bottom section are easily installed or disconnected by using dowel pins.

The same pivoting guide mechanism allows the top drive drilling system to be disconnected from the traveling block and moved laterally to a parked position behind the well bore axis, allowing tripping and workover operations without continuous hoisting of the top drive drilling system.

Finally, the top drive drilling system described herein substantially enhances safety because rapid response to well kicks is always available while drilling or tripping. There is no kelly to hoist that would delay closing in the well. When drilling, only the smooth drill pipe is rotating in the blowout preventer elements. By eliminating one-half to two-thirds of the connections, crew hazard exposure is similarly reduced.

The description of the preferred embodiment which follows refers to an earth drilling machine. It should be appreciated by those knowledgeable in oilfield activities that the torque restraint system is applicable to any drilling or workover rig, with a guyed leaning or vertical freestanding mast.

DESCRIPTION OF DRAWINGS

Drawings of a preferred embodiment of the invention are annexed hereto, so that the invention may be better and more fully understood, in which:

FIG. 112 is an enlarged elevational view similar to FIG. 2, illustrating the power swivel in a parked position detached from the traveling block;

Numeral references are employed to designate like parts throughout the various figures of the drawing.

DESCRIPTION OF A PREFERRED EMBODIMENT

Figure 1:
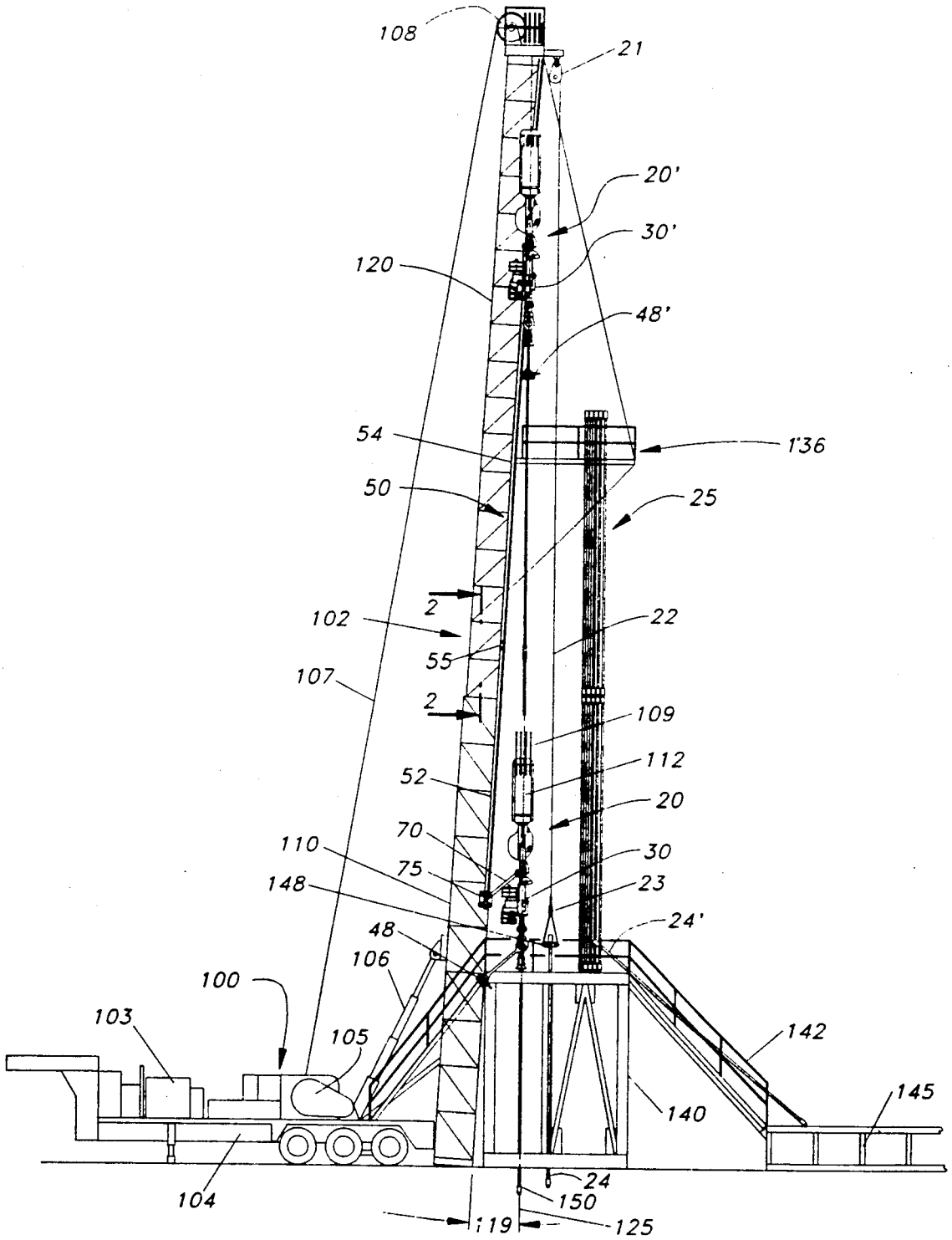
FIG. 1 is a diagrammatic side elevational view of a top drive drilling system mounted on an inclined mast.

Referring to FIG. 1 of the drawings, the numeral 20 generally designates a top drive drilling system including a power swivel 30 and guide mechanism 50 mounted on a mast 102 of a conventional portable rotary earth drilling rig generally designated by the numeral 100. As will hereinafter be more fully explained, the power swivel 30 is pivotally secured through a floating torque arm assembly, called a carriage 70, to a pair of dollies 75 movable longitudinally on a guide track 50 mounted on the mast 102. The guide mechanism 50 illustrated in FIGS. 7 through 9, and the carriage 70, illustrated in FIGS. 10 and 11 of the drawings, form a torque restraint system.

The drilling rig 100 is a conventional 118 foot vehicle-mounted hydraulically telescoping derrick, having an inclined mast 102 with a hook load capacity of, for example, 365,000 pounds. The mast 102 is typically inclined at a lean angle 119 of 3½ degrees relative to a vertical axis 125 centered over the well.

The mast 102 is pivotally mounted on a trailer 104 and is transported in a horizontal position with the upper mast section 120 telescoped into the lower mast section 110. When the mast 102 is erected, the telescoped sections 110 and 120 are rotated approximately 90 degrees about a horizontal axis to a vertical position by hydraulically-actuated rams 106. After legs on the lower mast section 110 engage the ground or other supporting surface, hydraulic fluid is delivered to hydraulically-actuated cylinders which raise the upper mast section 120 to the position illustrated in FIG. 1, wherein only the lower end of the upper section 120 extends downwardly into the upper end of the lower section 110.

The trailer-mounted rig includes a single drum draw works 105 powered by diesel engines 103 through conventional transmissions and a compound box. A fast line 107 extends from draw works 105 upwardly over a crown block 108, as illustrated in FIG. 1, to provide a number of lines 109 which carry a traveling block 112 connected to the power swivel 30 in the top drive system 20. A conventional folding substructure 140, equipped with a V-door 142, a catwalk 145, and two sets of pipe racks (not shown), parallel and juxtaposed to the catwalk, are mounted adjacent to the inclined telescoping mast 102.

The stand assembly system consists of a crown cantilevered single joint elevator snatch block 21 mounted directly over the mouse hole, an auxiliary cable 22, a live swivel assembly 23 and a single joint elevator 148. The system is permanently installed in the rig for use at any time.

The auxiliary cable 22 is designed to quickly attach to existing hydraulic or pneumatically-powered auxiliary tugger lines and is used to hoist a single joint 24' from the pipe ramp to the mouse hole, and to hoist a complete stand 25 from the mouse hole to the fingerboard 136 and set the stand 25 back on the setback.

The single joint elevator 148 is a specially-designed elevator with, for example, a 2,000 pound hoisting capacity for quick attachment to and release from the drill pipe. It is attached to the auxiliary cable 22 utilizing a live swivel assembly 23 to prevent unspiraling of the cable while shouldering up a stand 25 in the mouse hole.

During operation, a stand 25 is attached to or removed from the drill string 150, utilizing elevator 48.

The guide track 50 is rigid and continuous; it extends longitudinally along mast 102. The guide track 50, is formed in at least two segments: a lower guide track segment 52, and an upper guide track segment 54, secured to the lower mast segment 110 and upper mast segment 120, respectively (see FIG. 1). The guide track 50 shown can be comprised of, for example, 3½ inch standard pipe sections, each approximately 20 feet long (for easy handling). However, it should be appreciated that guide track 50 may be formed of members having non-circular cross-sections, such as H-beams, without departing from the basic concept of the torque restraint system.

Figure 2:
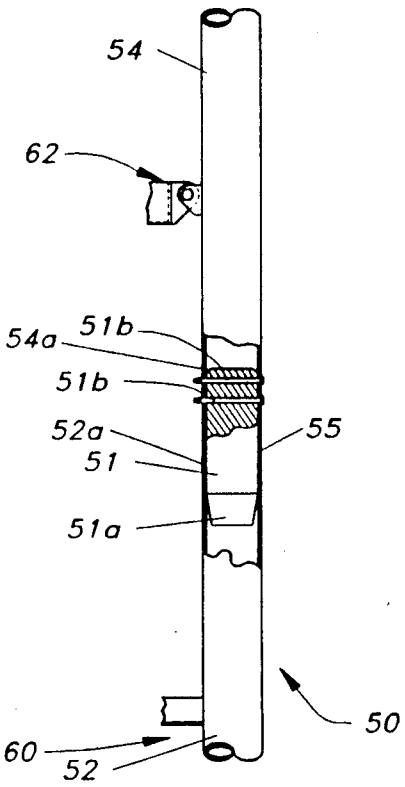
FIG. 2 is a cross-sectional view taken along line 2—2 of FIG. 1.

FIG. 2 illustrates how the guide track segments 52 and 54 are joined. A track guide pin 51 is retained in the lower end 54*a* of each upper track segment 54 by pins 51*b*. The lower end 51*a* of guide pin 51 is tapered to facilitate positioning pin 51 inside the upper end 52*a* of lower track segment 52 to form a smooth continuous guide surface at the intersection of the upper and lower guide track segments 52 and 54 in the vicinity of the connection 55 between the track segments. The guide track 50 is secured to the mast 102 by upper rail mounting bracket 62 and lower rail mounting bracket 60.

Figure 4:
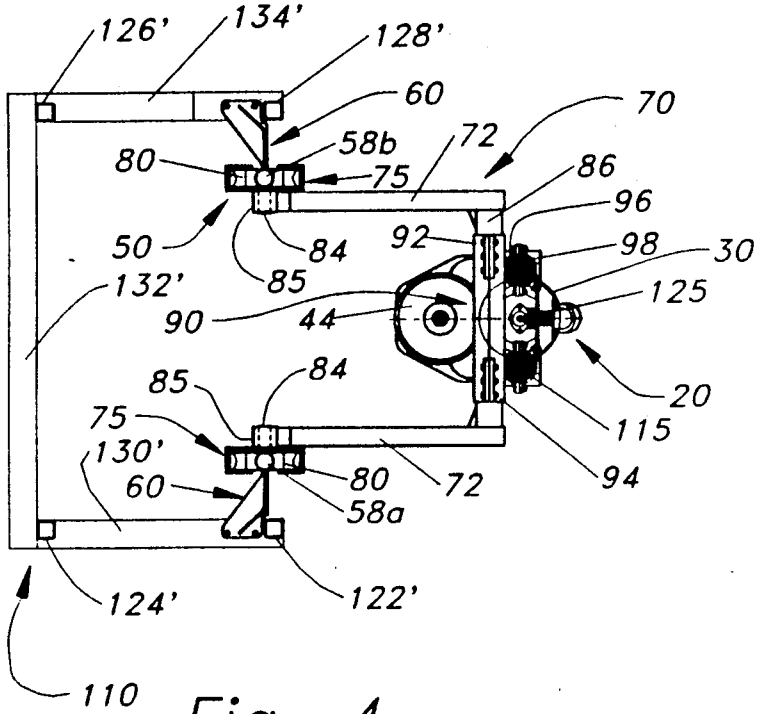
FIG. 4 is a cross-sectional view taken along line 4—4 of FIG. 3.
Figure 7:
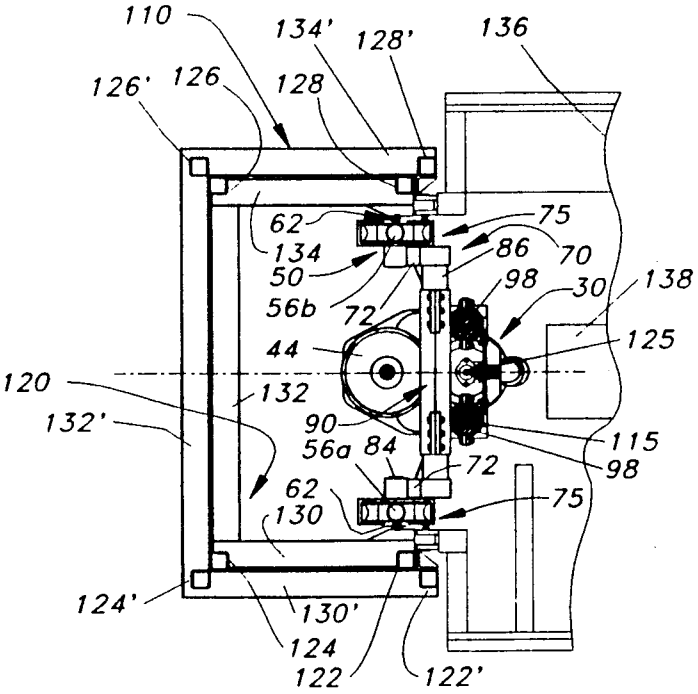
FIG. 7 is a cross-sectional view taken along line 7—7 of FIG. 6.

Each section 110 and 120 of the mast 102 is formed with four upwardly-extending leg members 122, 124, 126 and 128, as illustrated in FIGS. 4 and 7 of the drawings. The spacing between front leg members 122 and 128 of the upper mast section 120 is less than the spacing between front legs 122' and 128' of the lower mast section 110 to permit the telescoping action of the upper section 120 relative to the lower section 110. Suitable lattice cross bracing 130, 132 and 134 is secured around the upper section 120 of the mast 102 forming superimposed bays. Cross bracing members 130', 132' and 134' are secured around legs of the lower mast section 110 in a conventional manner. It should be appreciated that, even though the structure of mast 102 is configured to minimize deflection under normal operating conditions, due to its length and the magnitude of the live load which is periodically applied to the mast 102, the deflection between upper and lower ends of the mast 102 is substantial when a live load of, for example, 36,000 pounds, is suddenly applied to the mast 102. Legs of the upper and lower mast segments deflect under maximum loading in spite of the lattice formed by cross braces 130, 132, and 134 extending between legs 122, 124, 126, and 128 of each mast section 110 and 120.

The guide track 50, is comprised of lower guide track segments 54, formed by spaced lower rails 58*a* and 58*b*, as illustrated in FIG. 4, and upper guide track segments 54, formed by spaced upper rails 56*a* and 56*b*, as illustrated in FIG. 7. Spaced lower rails 58*a* and 58*b* are removably mounted adjacent to front legs 122' and 128' of lower mast section 110, as illustrated in FIG. 4, while spaced upper rails 56*a* and 56*b* are mounted adjacent to front legs 122 and 128 of the upper mast section 120.

Figure 5:
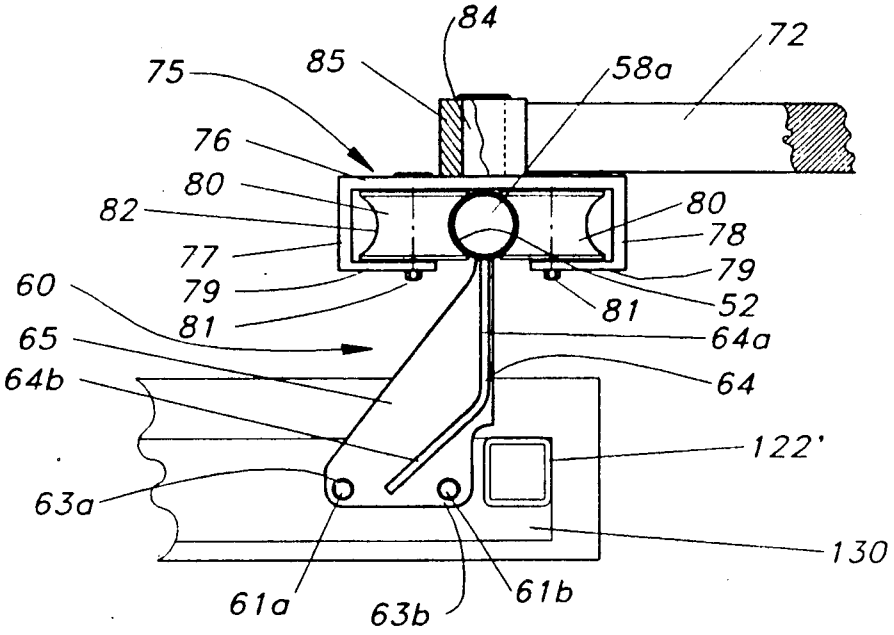
FIG. 5 is a cross-sectional view taken along line 5—5 of FIG. 3.

As best illustrated in FIG. 5 of the drawings, the lower rail mounting bracket 60 is formed by a curved flange member 64 having legs 64*a* and 64*b* welded or otherwise rigidly secured to a web 65. As shown in FIGS. 4 and 5, leg 64*a* of flange member 64 and web 65 are welded or otherwise rigidly secured to lower rails 58*a* and 58*b* of the lower guide track segment 52. A pair of pins 61*a* and 61*b* are welded or otherwise secured to each of the lateral braces 130 and 134 on the lower section 110 of mast 102; the pins 61*a* and 61*b* extend upwardly through apertures 63*a* and 63*b* formed in web 65 of each lower rail mounting bracket 60. It should be readily apparent that each lower guide track segment 52 is detachably secured by lower mounting brackets 60 and pins 61*a* and 61*b* to the lower mast section 110. Lower rail mounting brackets 60 are detachable from the lower mast section 110 to allow the upper mast section 120 to be telescoped downwardly into the lower mast section 110. A illustrated in FIG. 8 of the drawings, each upper guide track segment 54 has a vertically spaced lug 53 welded or otherwise rigidly secured thereto. An upper track mounting bracket 62 comprises a lug 57 welded or otherwise secured to a box member 59 secured by bolts 59*a* to the upper mast section 120.

Figure 9:
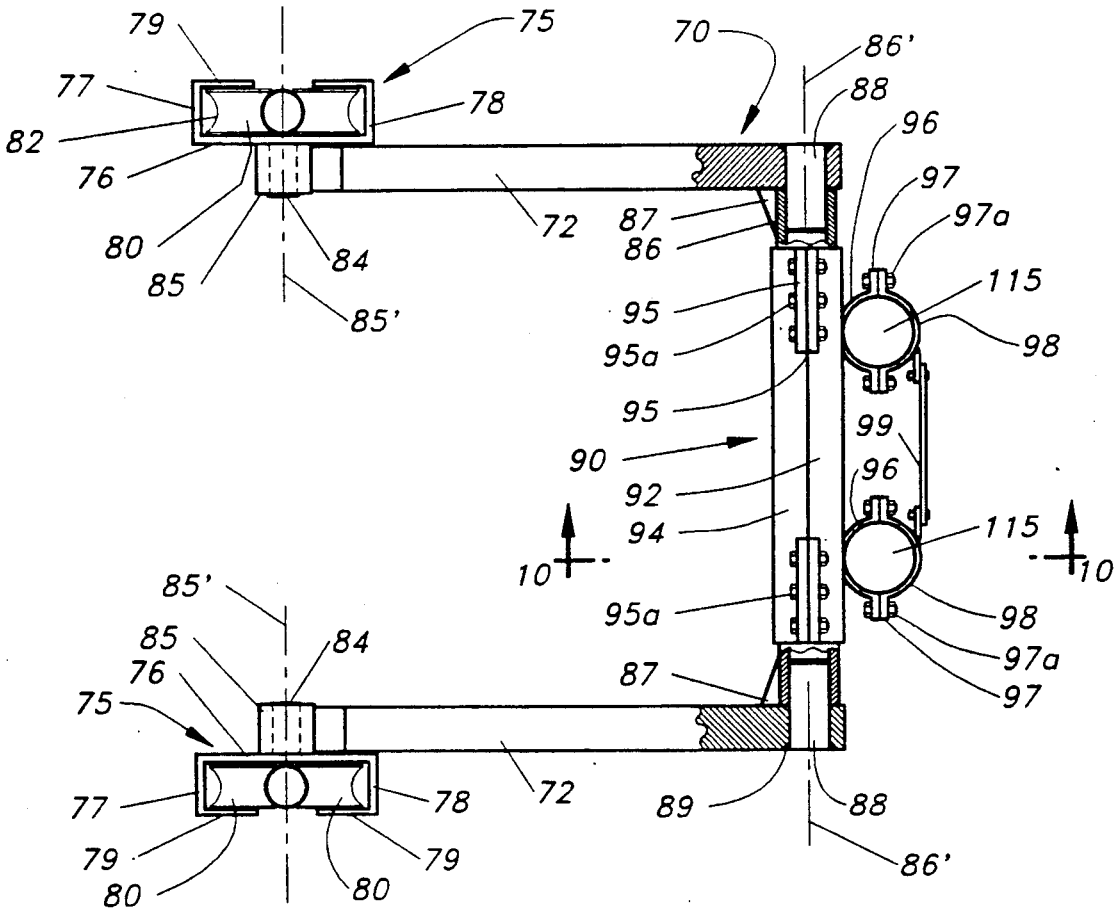
FIG. 9 is a top plan view of the torque arm carriage assembly detached from the power swivel.

Referring to FIGS. 4 and 7 of the drawings, it should be noted that upper rail mounting bracket 62 for securing upper rails 56*a* and 56*b* to the upper mast segment 120, and the lower rail mounting bracket 60 for securing lower rails 58*a* and 58*b* to the lower mast segment 110, are configured to align upper rails of the guide track 50 with the corresponding lower rails of the guide track 50. A carriage 70 is pivotally secured between rails 56*a*, 56*b*, and 58*a*, 58*b* of the guide track 50 and the bail 115 of power swivel 30. See FIGS. 4 and 7. As best illustrated in FIG. 9 of the drawings, the carriage 70 comprises a pair of spaced rigid torque arms 72 having bearings 85 formed on ends thereof and being rigidly secured to a cross shaft 86 pivotally secured to the power swivel 30 by a connector assembly 90. Cross shaft 86 is preferably a hollow tube having plugs 88 extending into opposite ends thereof. Each plug 88 preferably extends through an opening formed in one end of arm 72 and welded as indicated at 89 to form a strong rigid construction such that the pair of arms 72 are maintained in a common plane. Reinforcing ribs 87 provide structural reinforcing to assure that the pair of arms 72 and cross shaft 86 form a strong rigid construction adapted to rotate about spaced horizontal axes while resisting rotation of the power swivel 30 about a vertical axis 125.

Figure 8:
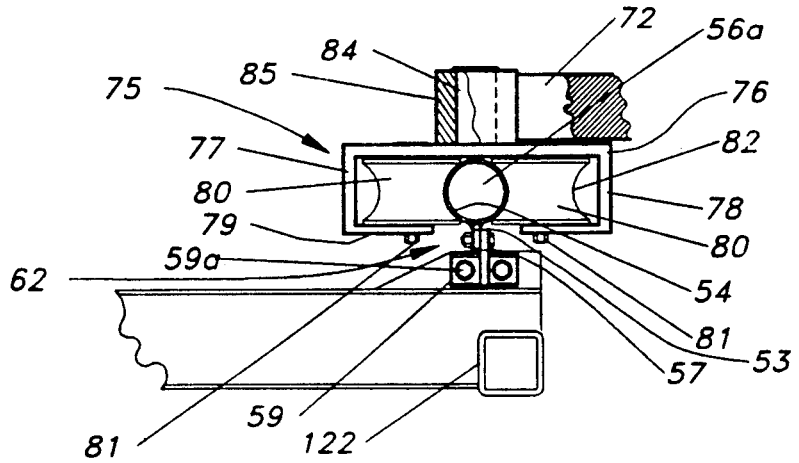
FIG. 8 is a cross-sectional view taken along line 8—8 of FIG. 6.

As illustrated in FIGS. 9 of the drawings, the ends of torque arms 72 have bearings 85 formed on lower ends thereof. Each bearing 85 has a central opening, having a generally horizontally-extending axis 85', through which a pivot pin 84, welded or otherwise secured to a web 76 formed on guide dollies 75, extends. As shown in FIGS. 5, 8 and 9 of the drawings, each dolly 75 comprises a frame having a generally channel-shaped configuration formed by a web 76 bounded on opposite edges by laterally-extending flanges 77 and 78, which in turn have spaced ribs 79 extending along edges thereof. The ribs 79 are aligned with each other and lie in a plane parallel to the plane of the web 76.

Each guide dolly 75 preferably has four shaped rollers 80 pivotally mounted by pins 81 each opposite end of which extends through an aperture in the rib 79 and an aperture in the web 76. Each roller 80 has a concave surface 82 which encircles slightly less than one-half of the circumference of each guide rail segment 52 and 54. See FIGS. 5, 8 and 9.

As illustrated in FIGS. 3, 4, 7, 9 and 10 of the drawings, the connector assembly 90 for pivotally securing carriage 70 to power swivel 30 comprises a horizontally- extending split bearing welded or otherwise secured to a pair of generally vertically-extending split clamp members. The horizontally-extending split bearing is formed by semi- circular bearing segments 92 and 94, each of which has an outwardly-extending flange 95 formed thereon such that the bearing segments 92 and 94 are connectable by bolts 95*a* to encircle the cross shaft 86.

Figure 10:
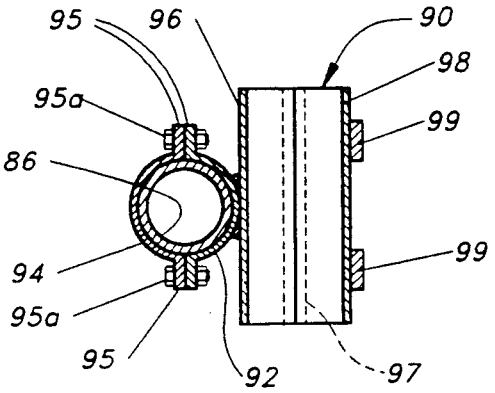
FIG. 10 is a cross-sectional view taken along line 10—10 of FIG. 9.

Each of the vertically-extending split clamp members includes first and second semi-cylindrical clamp segments 96 and 98, each of which has a flange 97 extending longitudinally thereof to facilitate joining clamp segments 96 and 98 by bolts 97*a*. Clamp segments 96 are welded or otherwise secured to the horizontally-extending bearing segment 92, as illustrated in FIGS. 9 and 10 of the drawings. Lateral braces 99 are secured to clamp segments 98 to maintain clamp segments 98 in a spaced parallel relationship. It should be appreciated that the pair of torque arms 72 is rotatable through an angle of 360 degrees relative to a horizontal axis 86' extending through the bore of the horizontally-extending split bearing formed by bearing segments 92 and 94. However, arms 72 are restrained against rotation about a vertical axis by connector assembly 90, which is detachably secured by clamp segments 96 and 98 to the bail 115 of power swivel 30.

From the foregoing, it should be readily apparent that carriage 70 is connectable by connector assembly 90 to bail 115 of a conventional power swivel 30, and that the guide track 50 is connected by lower mounting brackets 60 and upper mounting brackets 62 to a conventional inclined telescoping mast 102.

Figure 3:
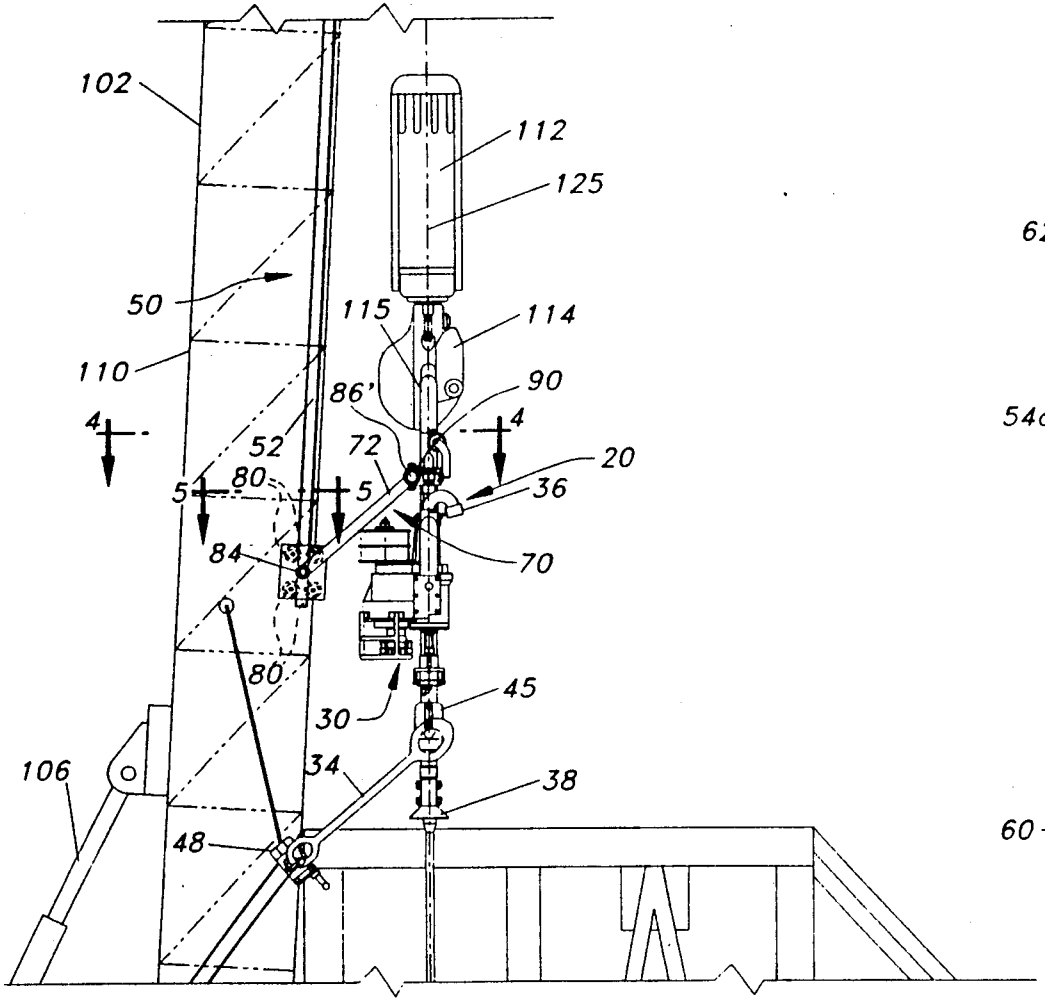
FIG. 3 is an enlarged fragmentary side elevational view illustrating a track and dolly assembly mounted on a power swivel in a drilled-down position.
Figure 6:
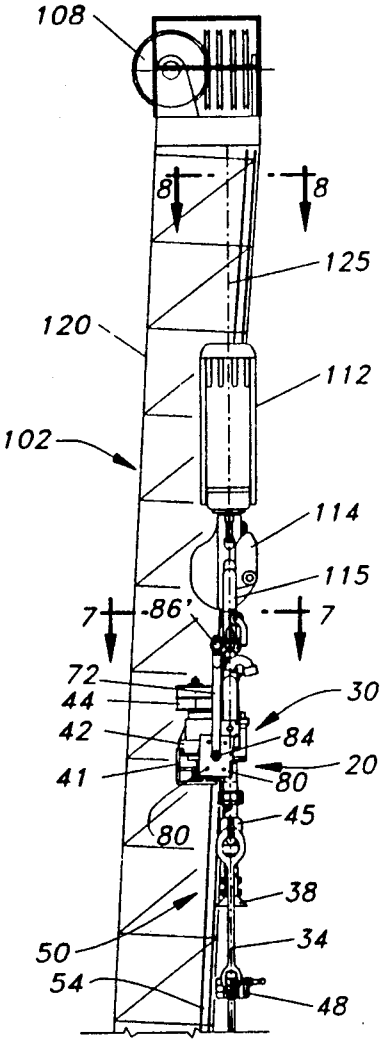
FIG. 6 is an enlarged fragmentary side elevational view illustrating a track and dolly assembly mounted on a power swivel in a stand-add position.

As the traveling block 112 moves vertically from the position illustrated in FIG. 3 of the drawings, to the elevated position illustrated in FIG. 6 of the drawings, arms 72 rotate about a horizontal axis 86' extending through the horizontally-extending bearing on connector assembly 90 as dollies 75 move along the inclined rails of the guide track 50. Since rigid arms 72 are pivotally secured to the power swivel 30 and are also pivotally secured to each dolly 75, the arms 72 are free to float and rotate freely about spaced horizontal axes 85' and 86'. However, rigid arms 72 transmit torque from the power swivel 30 to rails of the guide track 50 to prevent rotation of the bail 115 of the power swivel 30, which is suspended from and moved vertically along a vertical axis 125 by lines 109.

Figure 12:
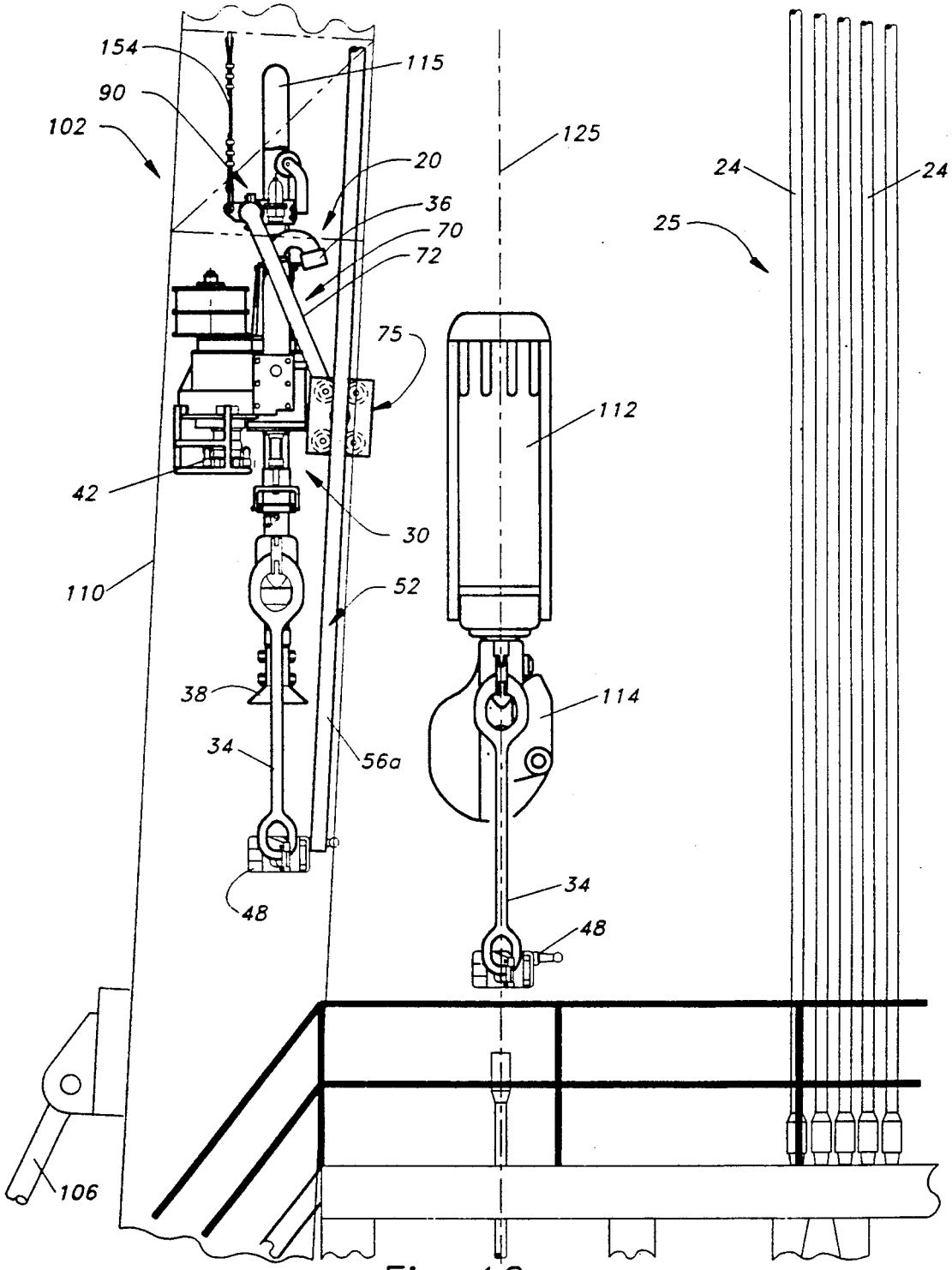

As illustrated in FIGS. 4 and 7 of the drawings, the distance between the vertical axis 125 along which the power swivel 30 moves and the inclined plane in which segments of the guide track 50 are disposed varies as the power swivel 30 moves vertically relative to the mast 102. As illustrated in FIG. 12 of the drawings, the power swivel 30 may be disconnected from the traveling block 112 and moved to a parked position in the mast 102 spaced from the axis 125.

Rigid arms 72 are spaced apart a distance greater than the maximum dimension of the power swivel 30. When the power swivel 30 is moved from the operating position illustrated in FIG. 3 of the drawings to the parked position illustrated in FIG. 12 of the drawings, arms 72 rotate such that upper ends of arms 72 move from a position inclined upwardly on one side of the guide track 50 to an inclined position on the opposite side of the guide track 50 such that the power swivel 30 is spaced from the vertical axis 125 extending upwardly from the well opening.

Figure 11:
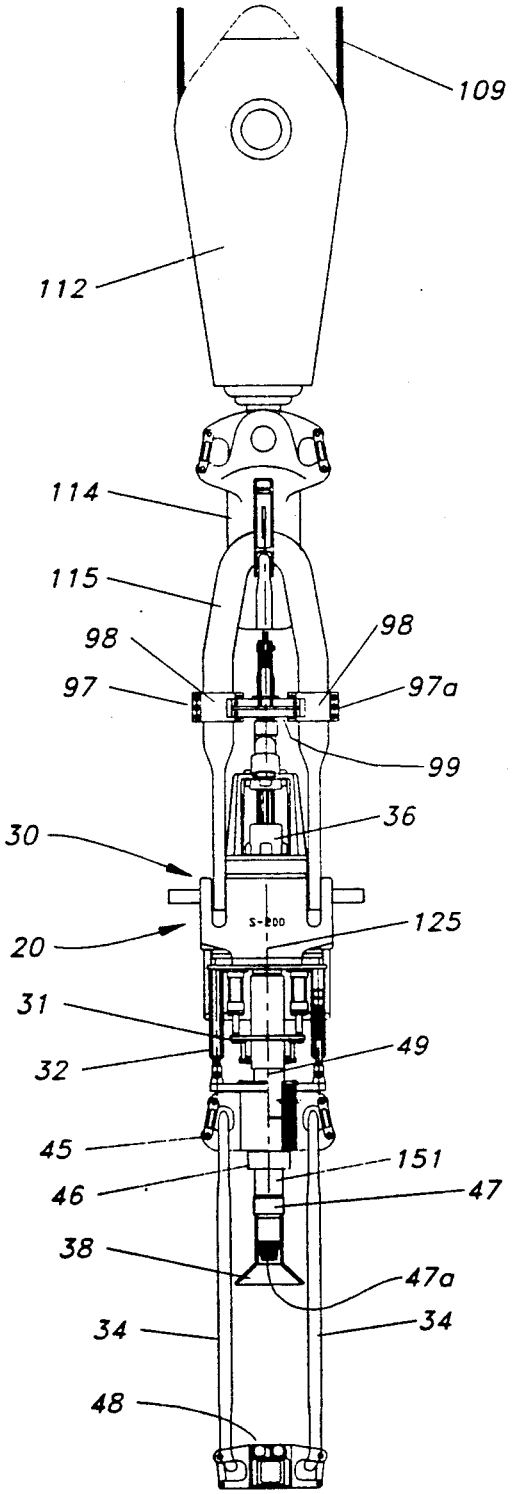
FIG. 11 is a front elevational view of a power swivel.

The top drive drilling system 20 is preferably hung off in a parked position such that its weight is vertically supported by a hang off cable 154, as illustrated in FIG. 12, in the back of the mast 102, to allow tripping and work-over operations with the conventional elevator 48, hook 114 and traveling block 112. The hang off cable 154 is secured to the mast 102 at any suitable location to support the weight of the power swivel 30 and carriage 70 when the top drive system 20 is moved laterally away from the axis 125 of movement of the traveling block 112. It should be appreciated that dollies 75 remain connected to lower guide track segments 52. The power swivel 30, illustrated in FIG. 11, is a conventional, hydraulic-motor-driven, pipe-rotating machine weighing only about 5,000 lbs. to support hoisting loads to 200 Tons and dynamic loads to 106 Tons at for example 100 Rpm.

The power swivel 30 incorporates a 3" bore gooseneck and washpipe assembly 36 allowing circulation through the stem while rotating or in a static condition (See FIGS. 3 and 12). A variable volume pump and hydraulic system (not shown) allows the torque and speed to be infinitely varied with no need to shift gears or stop and restart the unit to increase or decrease speed. The power swivel 30 is powered by two fixed displacement piston-type motors 42 rated at 5,000 Psi hydraulic pressure, mounted on the underside rear of the unit (See FIGS. 6 and 12). The motors 42 are protected from damage by a guard 41, illustrated in FIGS. 3 and 6 of the drawings.

Two high-pressure hydraulic hoses (not shown) and the motor drain hose (not shown) hang from the driller's side of the unit to the permanent mast-mounted hydraulic piping and are easily disconnectable through the use of self-sealing quick disconnect couplings. The motor drain is also provided with a self-sealing quick disconnect coupling.

The gear train of the power swivel 30 consists of two (2) motor drive gears, one (1) reduction drive gear, one (1) intermediate gear and one (1) main drive gear. These gears are held in close alignment and mesh by rolling element bearings.

As illustrated in FIGS. 6 and 7, the power swivel 30 is fitted with a conventional pneumatic brake 44 on the top of the reduction drive gear to provide 13,000 ft-lbs. of torque reaction for precise control of operations requiring exacting drive shaft orientation and for easy torque relief on down hole windup. The brake 44, which is pneumatically-controlled by the driller from his console, is a standard design, utilizing bladder and drum-type mechanisms that are widely used in the oil field. However, it should be appreciated that a hydraulically-released, spring-actuated brake may be used if it is deemed expedient to do so.

Because of the desirability for safe operation in a potentially explosive environment, the power swivel 30 is controlled by pneumatic components consisting of a driller's control console and the hydraulic power mounted pump controls.

A driller's control console (not shown) consists of a single lever-operated air valve for control of the power swivel's 30 direction and speed, another lever-operated air valve for control of engine speed, a lever-operated air valve for the control of the pneumatic brake, and a lever-operated on-off valve for control of the remote-controlled kelly valve. The console also contains a large diameter hydraulic pressure gauge calibrated in ft-lbs. displaying power swivel torque. Additionally, a hydraulic relief valve is used for precise control of swivel torque. The relief valve in the console remotely controls a torque limit control package mounted on the hydraulic power unit to limit torque. Torque control for these units is preset by turning the hydraulic relief valve until the desired torque is indicated on the calibrated pressure gauge. The control provides accurate and easily adjusted torque limits.

A conventional skid mounted hydraulic power unit (not shown) consists of an engine assembly with a hydraulic pump, hydraulic piping, hydraulic fluid reservoir, heat exchanger, torque limit control package, pump controls, and brackets to hold and transport the power swivel 30, driller's control console, and hydraulic hoses. The HPU skid is of heavy duty H-beam construction and provides a compact, easily transportable unit.

The hydraulic system (not shown) includes a direct-driven, variable displacement hydraulic pump, mounted directly to the engine flywheel housing, and all piping, valves, filters, fittings, hydraulic reservoir and other components required to complete the system. The complete system is designed and rated at for example 5,000 Psi working pressure.

A remote kelly valve actuator 31, shown in FIG. 11, is of conventional design and is used to open and close a conventional kelly safety valve; it is controlled by the driller from the driller's control console. The valve is always present in the traveling string for immediate response to well control procedures. It may be reconnected to the drill string 150 at any point in the mast 102 by setting the slips on the drill pipe, slacking off on the drawworks, and reconnecting, using the stabbing bell 38.

The top drive drilling system 20, as illustrated in FIG. 11, includes a conventional link adaptor and hoisting system, which consists of a link adaptor 45, removable load collar 46, grooved sub 151, long links 34, and an elevator 48. The link adaptor 45 is designed for 200 Ton rated load and transfers the weight of the drill string 150 to the swivel stem 49.

The link adaptor 45 lands out on the removable load collar 46 which is attached to the groove sub 151 made up to the swivel stem 49. The link adaptor is held above the removable load collar by the link adaptor compensating system when the saver sub 47 is connected to the drill string 150, thus preventing rotation of the link adaptor and elevator 48 during drilling operations. When the drill string 150 is being supported through the elevator 48, the link adaptor is allowed to rotate on the power swivel main bearing.

As illustrated in FIG. 11, the stabbing bell 38 is a split and hinged removable guide located around the connection of the saver sub 47; it is used to guide the pin 47*a* of the saver sub 47 into the box of the stand 25 being added to the drilling string 150. The saver sub 47 is the lowermost connection in the top drive drilling system 20. This pin down saver sub 47 is formed to engage the drill string connections.

PIPE HANDLING OPERATIONS

The top drive drilling system 20 is an integrated unit combining the functions of pipe rotating with a pipe handling system.

Due to the portable nature of the land based drilling rig 100, implementing top drive drilling techniques requires a system for making up and setting back stands 25 to be added to the drill string 150 as drill down continues. Such a system offers the advantage of drilling down an entire stand 25 between connections.

Figure 13:
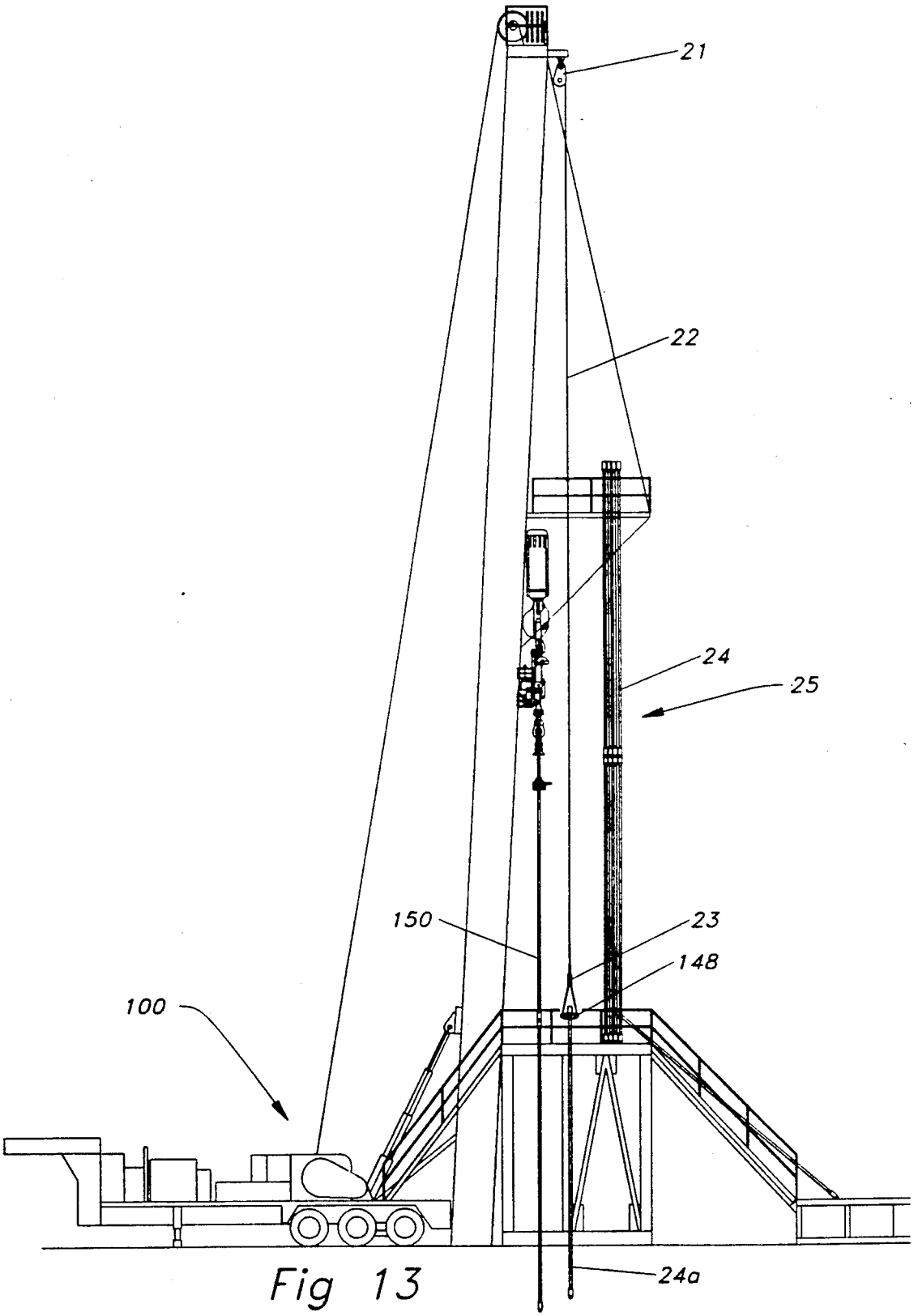
FIGS. 13, 14 and 15 are diagrammatic illustrations of a sequence of steps for making-up stands of drill pipe.
Figure 14:
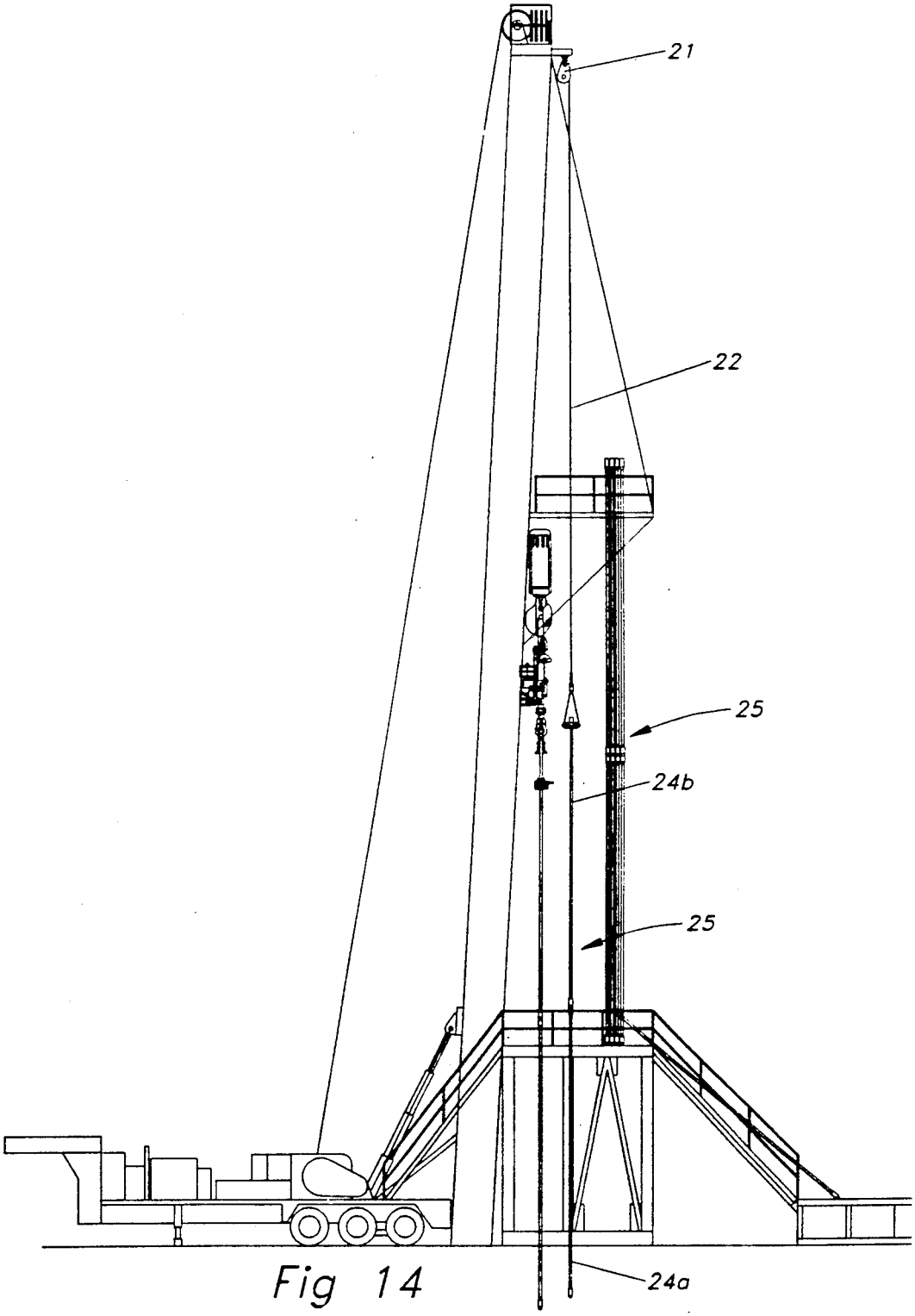
Figure 15:
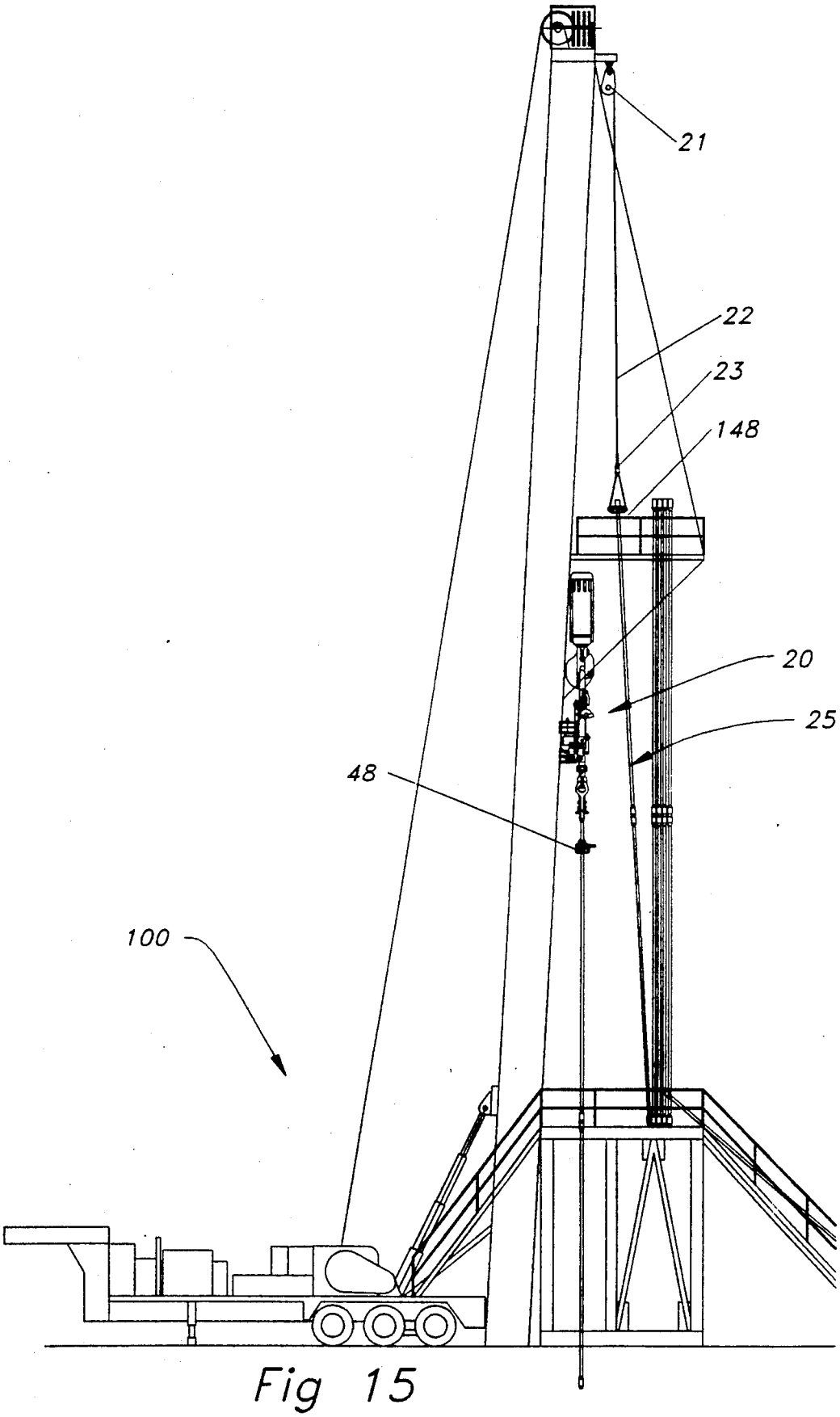

FIGS. 13, 14 and 15 of the drawings show the procedure to make-up a stand 25. The first step is picking up a single joint 24*a* of drill pipe from the pipe ramp, putting it into the mousehole and energizing the back-up jaws against the drill pipe. Referring to FIG. 14 the next step is picking up another single joint 24*b* from the pipe ramp using the single joint elevator 148 and live swivel assembly 23. The single joint 24*b* is hoisted until the pin of joint 24*b* can be stabbed into the box of the joint 24*a* in the mouse hole. The single joint 24*b* is rotated relative to joint 24*a* to fully engage the mating threads of the connection. As shown in FIG. 15, the stand 25 is then hoisted out of the mouse hole. Lower pin is moved into position over the setback and is set on the setback. The derrickman moves the box end of stand 25 into position in the fingerboard 136 and opens the single joint elevator 148 to release the stand 25. The single joint elevator 148 is then returned to the drill floor. The above described procedure is repeated until the required number of stands 25 are made up. This procedure may be used while drilling continues with the top drive drilling system 20.

Figure 16:
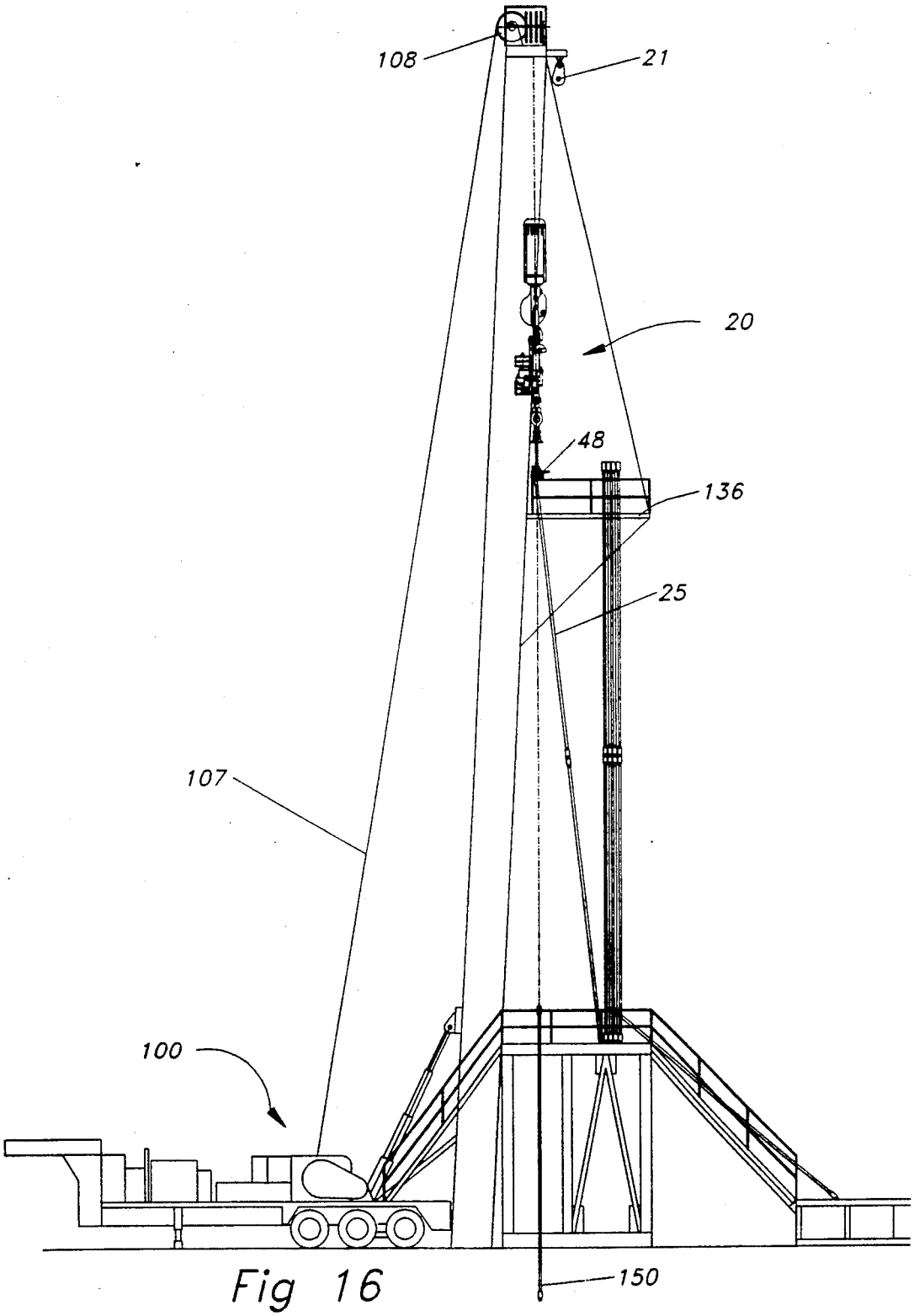
FIGS. 16, 17 and 18 are diagrammatic illustrations of a sequence of steps for adding a stand of drill pipe to the drilling string.
Figure 17:
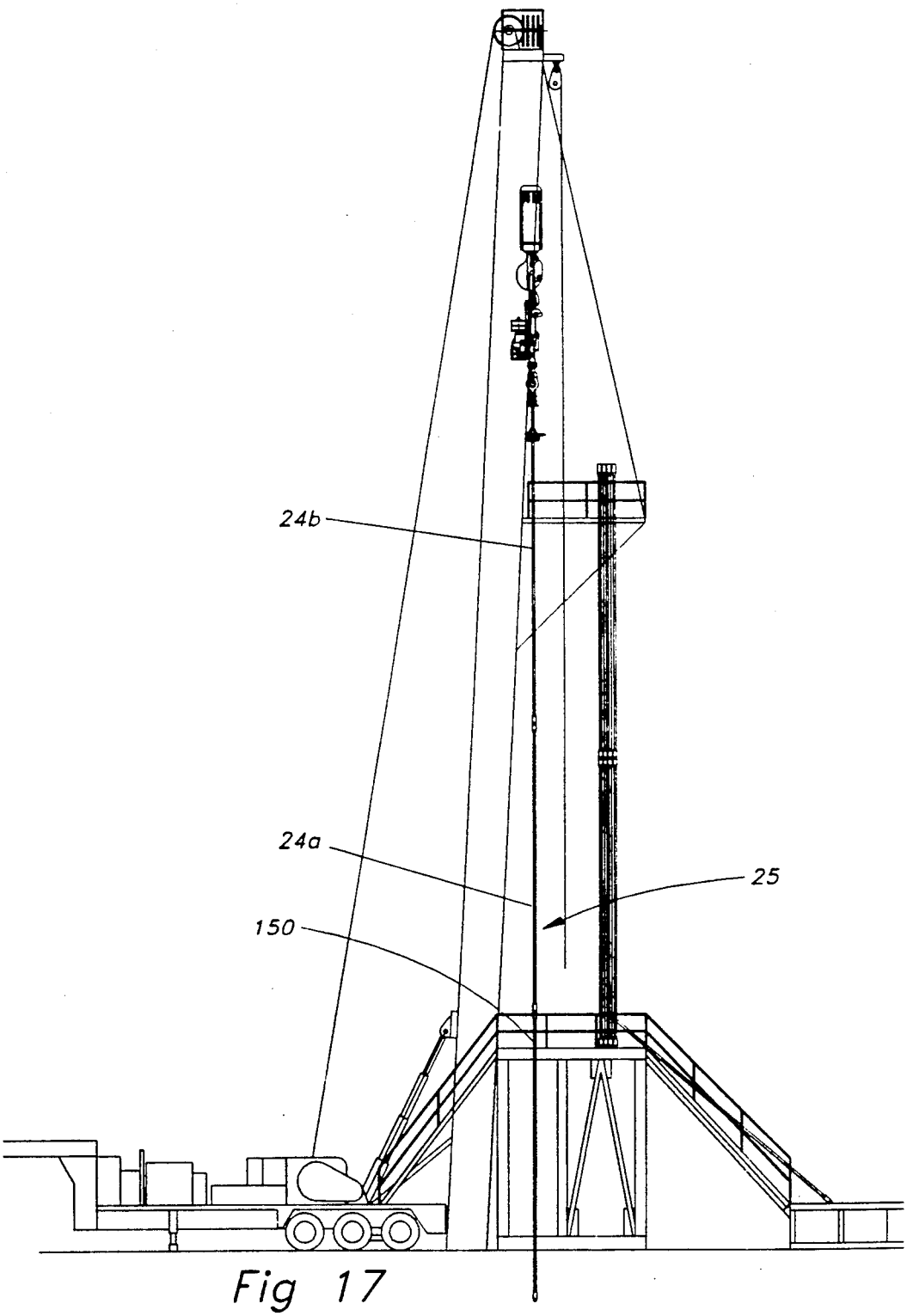
Figure 18:
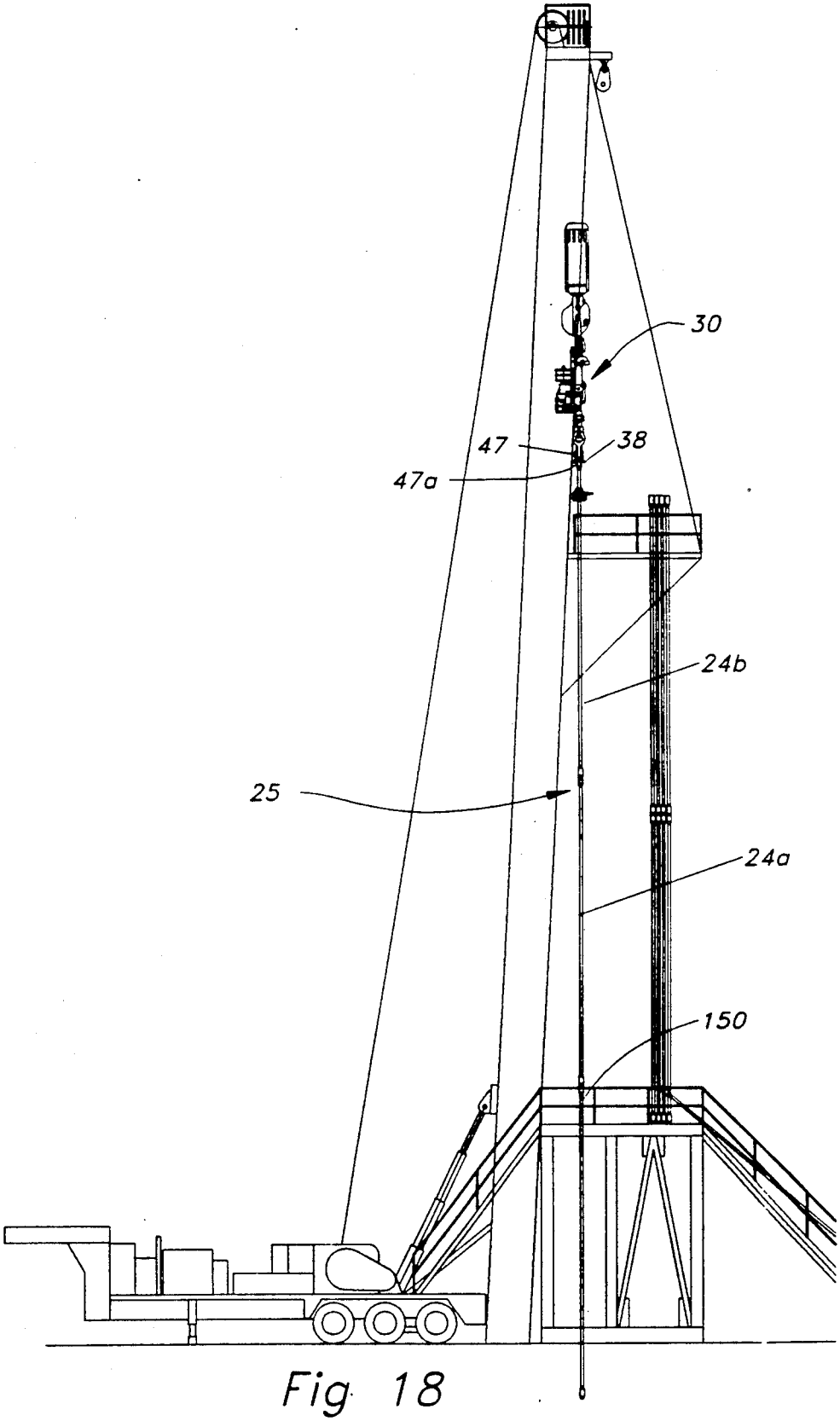

FIGS. 16, 17 and 18 of the drawings show the stand add procedure. First, the driller hoists the top drive 20 above the fingerboard 136. The derrickman moves the top of the stand 25 to be added to the drill string 150 from the fingerboard 136 and puts it securely into the elevator 48.

As illustrated in FIG. 17, the driller hoists the stand 25 until the pin is above the box setting in the slips. Floor hands guide the pin into the box while the driller slacks off. Referring to FIG. 18, the driller continues to slack off until the box of the stand 25 being added goes into the stabbing bell 38 and the pin 47*a* of the saver sub 47 enters the box of the stand 25. The driller starts the power swivel 30 rotating forward slowly while slacking off on the brake, allowing the upper and lower connections to be spun up simultaneously.

The floor hands put a back-up tong (not shown) on the box at the floor. The driller increases the torque from the to drive 20 until the desired make-up torque is obtained. Circulation can now be established. The back-up tong is removed.

The driller hoists the top drive 20 slightly to remove the slips. Full drilling operations can now be resumed. During drill down, as the elevator 48 gets close to the top of the rotary table in the position illustrated in FIG. 3, the floor hands attach an auxiliary cable 153 to the back handle of the elevator 48 and open the elevator 48. The elevator 48 and the links 34 are tilted back to allow drilling the top drive 20 down to the rotary table.

After drilling down a stand 25, the driller hoists the top drive 20 until the first box is out of the rotary and the slips are set on the drill string 150. The floor hands use a back-up tong on the box of the drill pipe in the slips. The driller uses the top drive 20 in reverse to back out of the connection. The floor hands disconnect the auxiliary cable 153 from the back handle of the elevator 48 as the driller hoists the top drive 20 to the fingerboard 136.

For back reaming, the driller slacks off until the elevator 48 is above the box suspended in the rotary. The floor hands attach an auxiliary line to the rear handle on the elevator 48, pulling it back, allowing the driller to slack off until the pin 47*a* of the saver sub 47 stabs into the box of the top of single joint 24.

Floor hands put a back-up tong on the box. The driller rotates the power swivel 30 forward until the connection shoulders up, following the thread advance with the drawworks brake. The driller then increases the torque applied by the power swivel 30 until the desired make-up torque is achieved. This torque must be less than that previously applied to the string 150 in order to break-out in the mast 102 after hoisting a stand 25. Circulation can now be reestablished. The driller hoists the top drive 20 and slips ar removed. Rotation of the drill string 150 ca be resumed while hoisting stand 25 out of hole.

After the stand 25 is hoisted out of the hole, the slips are at an appropriate height, and rotation and circulation stopped. A back-up tong is put on the box of joint 24*b* in the slips. The driller rotates the power swivel 30 in reverse to back out of the connection at the saver sub 47 and the top of the stand 25. The connection should break at this point because of the lower torque previously applied. Once the saver sub pin 47*a* is clear of the upper box, the driller hoists the top drive 20 approximately one (1) foot.

The floor hands break and spin out the lower connection using standard procedures, as if tripping out of the hole. The driller hoists the top drive 20 to jump the lower pin of the stand 25 out of the box. Floor hands push the pin of the stand 25 into position over the setback. The driller slacks off until the pin is on the setback so the derrickman can remove the stand 25 from the elevator 48 and put it into the appropriate position in the fingerboard 136.

Since the elevator 48 is always on the top drive drilling system 20, the tripping procedure is simply an operational procedure to switch from rotating and circulating mode to the tripping mode, with no equipment to rig up. Additionally, the procedures in the tripping mode are the same as used in conventional kelly drilling.

For tripping in the hole, the driller hoists the top drive 20 above the fingerboard 136. The derrickman moves the upper end of the stand 25 from its position in the fingerboard 136 and delivers it to the elevator 48.

The driller hoists the stand 25 until it clears the box in the rotary, and floor hands guide the pin into the box as the driller slacks off. After the connection has been made up using conventional procedures, the string 150 is hoisted and slips removed. Stand 25 is lowered into the hole and the slips are set at the appropriate height above the rotary table. The elevator 48 is opened, and the driller hoists the top drive 30 above the fingerboard 136. The above procedure is repeated until all the pipe is in the hole.

For tripping out of the hole, the driller slacks off the top drive 30 until the elevator 48 is above the joint 24b suspended in the slips. The floor hands pull the elevator 48 back, allowing it to be lowered below the upset on the box connection, and latch the elevator 48 on to the drill string 150.

The driller hoists the drill string 150 so the slips can be removed. After a full stand 25 has been hoisted from the hole, the slips are set and the stand 25 is broken-out using conventional procedures. The lower pin is positioned by the floor hands over the rotary table. The driller slacks off until the pin is resting on the setback. The derrickman then removes the upper end of the stand 25 from the elevator 48 and puts it into the proper position in the fingerboard 136.

It should be appreciated that the distance between the power swivel 30 and the mast 102 changes as the swivel 30 moves vertically. However, the pair of rigid torque arms 72 pivot to accommodate the changing distance, while providing torque-restraining structure which does not apply loading which would reduce the capacity of the mast 102.

I claim:

1. A torque restraint system for a top drive unit in a drilling rig, said system comprising:

a mast;

a guide track extending longitudinally along said mast;

means for securing said guide track to said mast;

a carriage movable along said guide track;

a motor for developing torque about a vertical axis;

at least one pair of spaced torque arms rigidly connected to maintain a common plane, one end of said torque arms pivotally connected to said carriage and the other end of said torque arms pivotally connected to said motor such that said torque arms are rotatable at least 180 degrees about a horizontal axis, said torque arms thereby functioning to transmit reactive force from said motor to said mast to prevent rotation of said motor about said vertical axis.

2. The torque restraint system of claim 1, wherein said guide track comprises a plurality of track segments, with means for securing an end of each of said track segments to an end of another of said track segments.

3. A torque restraint system for a top drive unit in a drilling rig, said system comprising:

a mast inclined relative to a vertical axis;

a guide track extending longitudinally along said inclined mast and parallel to said inclined mast;

means for securing said guide track to said inclined mast;

a carriage movable along said guide track;

a motor for developing torque about a vertical axis;

at least one pair of spaced torque arms rigidly connected to maintain a common plane, one end of said torque arms pivotally connected to said carriage and the other end of said torque arms pivotally connected to said motor such that said torque arms are rotatable at least 180 degrees about a horizontal axis, such that said torque arms pivot upon the movement of said motor along the vertical axis while said carriage moves laterally with respect to said vertical axis, while moving longitudinally along said guide track, such torque arms thereby functioning to transmit reactive force from said motor to said mast to prevent rotation of said motor about said vertical axis.

4. A torque restraint system for use with a power swivel in a drilling rig having a traveling block movably suspended for movement along an axis, the system comprising:

a mast;

a motor;

means to detachably secure the motor to the traveling block;

support means secured to the mast to support the motor in a position spaced horizontally from a vertical axis when the motor is detached from the traveling block;

a guide track extending longitudinally along said mast;

means for securing said guide track to said mast;

a carriage movable along said guide track;

at least one pair of spaced torque arms rigidly connected to maintain a common plane, one end of said torque arms pivotally connected to said carriage and the other end of said torque arms pivotally connected to said motor such that said torque arms are rotatable at least 180 degrees about a horizontal axis, such rotatability allowing the lateral displacement of the motor from an operating position to a parked supported by said support means.

5. The torque restraint system of claim 4, wherein said mast is inclined relative to a vertical axis, and said guide track extends parallel to said inclined mast.

* * * * *